US007209683B2

(12) United States Patent
Abe et al.

(10) Patent No.: US 7,209,683 B2
(45) Date of Patent: Apr. 24, 2007

(54) CHARGING ROLLER FEATURING SPECIFIED RATIO OF STORAGE ELASTIC MODULUS AND DYNAMIC VISCOELASTICITY VALUES AND PROCESS CARTRIDGE AND ELECTROPHOTOGRAPHIC APPARATUS FEATURING THE SAME

(75) Inventors: Hiroshi Abe, Ushiku (JP); Hirobumi Takahashi, Ushiku (JP); Ayumi Okuda, Moriya (JP); Tomoya Kawakami, Ushiku (JP)

(73) Assignee: Canon Kasei Kabushiki Kaisha, Tsukuba-shi (JP)

( * ) Notice: Subject to any disclaimer, the term of this patent is extended or adjusted under 35 U.S.C. 154(b) by 0 days.

(21) Appl. No.: 11/434,121

(22) Filed: May 16, 2006

(65) Prior Publication Data

US 2006/0204280 A1 Sep. 14, 2006

Related U.S. Application Data

(63) Continuation of application No. PCT/JP2006/303336, filed on Feb. 17, 2006.

(30) Foreign Application Priority Data

Feb. 21, 2005 (JP) ..... 2005-044045
Feb. 21, 2005 (JP) ..... 2005-044046
Feb. 3, 2006 (JP) ..... 2006-027023

(51) Int. Cl.
*G03G 15/02* (2006.01)

(52) U.S. Cl. ..... 399/168; 399/174; 399/176

(58) Field of Classification Search ..... 399/168, 399/174, 176
See application file for complete search history.

(56) References Cited

U.S. PATENT DOCUMENTS 4,627,703 A * 12/1986 Suzuki et al. ..... 399/143
4,967,231 A * 10/1990 Hosoya et al. ..... 399/176
6,555,210 B1 * 4/2003 Masuda et al. ..... 428/212
6,704,539 B2 * 3/2004 Nakayama ..... 399/350
2003/0081971 A1 * 5/2003 Nakayama ..... 399/350
2005/0047833 A1 * 3/2005 Fujiwara ..... 399/297

FOREIGN PATENT DOCUMENTS

JP 04025868 A * 1/1992

(Continued)

*Primary Examiner*—David M. Gray
*Assistant Examiner*—Geoffrey T Evans
(74) *Attorney, Agent, or Firm*—Fitzpatrick, Cella, Harper & Scinto

(57) ABSTRACT

Charging roller has at least a support member and a conductive covering member, the charging roller where a value of tan δ expressed in a ratio of a storage elastic modulus and a loss elastic modulus by dynamic viscoelasticity in a cross sectional direction of the charging roller at 25° C. is 0.2 or more in a range of 1 to 20 kHz and 0.2 or less in a range of 1 to 10 Hz, or a charging roller where the conductive covering member is constructed of two or more layers and a value of tan δ in at least one layer other than a surface layer is 0.2 or more at 10 Hz in a range of 10 to 50° C. and a value of tan δ in a cross sectional direction of the whole charging roller is 0.2 or less at 10 Hz in a range of 10 to 50° C.

4 Claims, 3 Drawing Sheets

FOREIGN PATENT DOCUMENTS

| | | | |
|---|---|---|---|
| JP | 8-262835 | | 10/1996 |
| JP | 08262835 A | * | 10/1996 |
| JP | 10319676 A | * | 12/1998 |
| JP | 11125892 A | * | 5/1999 |
| JP | 11-249384 | | 9/1999 |
| JP | 2000-275930 | | 10/2000 |
| JP | 2002-235730 | | 8/2002 |
| JP | 2004-93585 | | 3/2004 |

* cited by examiner

CHARGING ROLLER FEATURING SPECIFIED RATIO OF STORAGE ELASTIC MODULUS AND DYNAMIC VISCOELASTICITY VALUES AND PROCESS CARTRIDGE AND ELECTROPHOTOGRAPHIC APPARATUS FEATURING THE SAME

This application is a continuation of International Application No. PCT/JP2006/303336, filed Feb. 17, 2006, which claims the benefit of Japanese Patent Application No. 2005-044045, filed Feb. 21, 2005, Japanese. Patent Application. No. 2005-044046, filed Feb. 21, 2005 and Japanese Patent Application No. 2006-027023, filed Feb. 3, 2006.

BACKGROUND OF THE INVENTION

1. Field of the Invention

The present invention relates to a charging roller, and a process cartridge and an electrophotographic apparatus which each have the charging roller. More particularly, the present invention relates to a charging roller charging a surface of an electrophotographic photosensitive member at predetermined potential by applying a voltage to the charging roller which is arranged on contact with an electrophotographic photosensitive member, and a process cartridge and an electrophotographic apparatus which each has the charging roller.

2. Related Background Art

Heretofore, many methods are known as electrophotography methods. A general method for obtaining a duplication comprises the steps of using a photoconductive substance, forming a electric latent image on an electrophotographic photosensitive member by various means, making the latent image a visible image by performing development with toner, transferring a toner image to a transferring material such as paper if needed, and fixing the toner image, on a transferring material by heat, pressure, or the like thereafter. In addition, toner particulates which remain on the electrophotographic photosensitive member without being transferred on the transferring material are removed from the electrophotographic photosensitive member at a cleaning step.

Heretofore, as a charging device used in electrophotography, a corona charging device has been used. In recent years, the contact charging device has been put in practical use instead of this. This aims at low ozone and low power, and in particular, a roller charging method which uses an electroconductive roller as a charging member among this type of devices is preferably used in view of charging stability.

In the roller charging method, a conductive elastic roller is pressed on contact with a charged body, and the charged body is charged by applying a voltage to the conductive elastic roller.

Specifically, since charging is performed by discharge to a charged body from a charging member, charging is started by applying a voltage more than a certain threshold voltage. For example, when a charging roller is pressed on contact with an organic electrophotographic photosensitive member (OPC electrophotographic photosensitive member) which has 25-μm-thick photosensitive layer, surface potential of the electrophotographic photosensitive member starts to rise when applying a voltage of about 640 V or more in an absolute value. Thereafter, surface potential of the electrophotographic photosensitive member increases linearly at an inclination of 1 to the applied voltage. Hereafter, this threshold voltage is defined as a charging start voltage Vth.

Thus, in order to obtain a surface potential Vd of an electrophotographic photosensitive member needed for electrophotography, a DC voltage, which is higher than a voltage needed for image formation itself, such as Vd+Vth, is needed for a charging roller. A method of applying only a DC voltage in this way to a contact charging member to perform charging is called DC charging.

However, in the DC charging, since the resistance of a contact charging member is easily changed by environmental fluctuation and the like and Vth is changed when the film thickness is changed by the electrophotographic photosensitive member being worn away, it is difficult to bring the potential of the electrophotographic photosensitive member into a desired value.

For this reason, in order to achieve further equalization of charging, an AC+DC charging method of applying a voltage, obtained by superimposing an AC component having a peak-to-peak voltage of 2×Vth or more on a DC voltage equivalent to the desired Vd, to a contact charging member is used. This aims at a potential leveling effect of AC. Potential of a charged body is converged on Vd which is a center of peaks of the AC voltage, and it is not affected by disturbances such as an environment.

As a conductive member for charging, there is an example of forming a surface layer with a conductive seamless tube on a conductive support member (for example, refer to U.S. Pat. No. 4,967,231). Furthermore, a seamless tube which is made of a fluorocarbon resin is disclosed, and a multilayer tube which is constructed of layers whose conductivities are different is also disclosed. As a method concerning production as a charging member, a method of forming the charging member by insertion is mentioned as the above-mentioned conventional technology. In addition, a surface formation method using a cross head extruder is also proposed.

Even if using a foam as an elastic layer on a substrate, such a method of forming a charging roller with a seamless tube can form a uniform face by further covering the charging roller with the seamless tube. Hence, it is possible to achieve more uniform charging.

Means taken to cover a support member with a seamless tube is to achieve fitting by shrinking the tube by physical or chemical means, for example, heat with making an internal diameter of the seamless tube larger than an outer diameter of the support member to be covered, or to achieve fitting by expanding the tube by physical or chemical means, for example, air pressure with making an internal diameter of the seamless tube smaller than an outer diameter of the support member to be covered. In addition, it is also possible to use a multilayer co-molding tube (e.g., refer to Japanese Patent Application Laid-Open No. H11-125952).

As methods of giving electroconductivity to a seamless tube, there are generally an ionic conduction method of using salt as an electroconductive agent, and an electronic conduction method of using carbon black, a conductive metal oxide, metal powder, or the like as an electroconductive agent. When electroconductivity is given by the ionic conduction method, there arises a problem that environmental fluctuation of resistance becomes large easily, and that salt tends to pollute an electrophotographic photosensitive member since the charging roller abuts on the electrophotographic photosensitive member.

Nevertheless, when a contact charging device like the above is adopted as charging means of an electrophotographic apparatus which forms an electrostatic latent image by line scanning on an electrophotographic photosensitive member which is a charged body, for example, a laser beam printer, there are the following problems. When an image pattern with repetition of radiation and unradiation of a laser beam which is high density at equal intervals in a subscanning direction is outputted, a moire pattern may arise in an image face when a frequency of an AC voltage, which is applied to a contact charging member, and a spatial frequency of the image pattern become near. Although this is solvable when making the frequency of the AC voltage high enough, it becomes easy to generate vibration noise since the contact-charging member and electrophotographic photosensitive member touch. Hence, it is an extremely inconvenient defect in order to reduce noise at the time of operation of a printer or the like particularly in an office environment, or the like.

The vibration noise (hereafter, this is called a "charging noise") in the contact charging method is caused by vibration generated by an exciting force of the AC voltage applied since the AC voltage is applied in a state that the charging member and charged body abut each other. It is considered that the vibration is caused by the charging member "patting" the charged body by the AC voltage frequency, an electric field force, and a restoring force of the elastic material. Hence, so as to reduce the charging noise, a method of making the whole charging member or an elastic material be low hardness, i.e., soft is generally adopted (e.g., refer to Japanese Patent Application Laid-Open No. H4-25868).

On the other hand, with paying attention to tan δ and storage elastic modulus in dynamic viscoelasticity measurement of an elastic layer or a surface coating film layer, there are means of enlarging tan δ (e.g., refer to Japanese Patent Application Laid-Open No. H8-262835), and means of controlling a value of tan δ and lowering a storage elastic modulus, that is, lowering hardness (e.g., refer to Japanese Patent Application Laid-Open No. H10-319676). The charging member having these features increases its silence property in comparison with the conventional ones. Nevertheless, there is still room for improvement such as easy generation of more jarring noise in a higher tone due to acceleration of the charging frequency in recent years, and easy hearing of the charging noise due to miniaturization, until it reaches a level that general users can use it satisfactorily.

Furthermore, lowering hardness or enlarging tan δ may cause problems such as a poor image and deterioration of charging noise in connection with shape deterioration due to an abutting portion of the charging roller being deformed by permanent set because of the charging roller and electrophotographic photosensitive member being kept in an abutting state for long time.

SUMMARY OF THE INVENTION

The present invention relates to a contact type charging roller which contacts a charged body, and which is charged by a voltage including an AC component being applied, and aims at providing a charging roller, which reduces noise generated from the charging roller (charging noise), prevents deformation due to compression set, and can obtain a stable and satisfactory uniform charging characteristic and output image quality, a process cartridge and an electrophotographic apparatus which each have the charging roller.

The present invention provides a charging roller which has at least a support member and a conductive covering member, the charging roller characterized in that a value of tan δ expressed in a ratio of a storage elastic modulus and a loss elastic modulus by dynamic viscoelasticity in a cross sectional direction of the charging roller at 25° C. is 0.2 or more in a: range of 1 kHz or more and 20 kHz or less, and 0.2 or less in a range of 1 Hz or more and 10 Hz or less.

In addition, the present invention provides a charging roller which has at least a support member and a conductive covering member, the charging roller being characterized in that the conductive covering member is constructed of two or more layers, and that a value of tan δ expressed by the ratio of a storage elastic modulus and a loss elastic modulus by dynamic viscoelasticity in at least one layer other than a surface layer is 0.2 or more at 10 Hz in a range of 10° C. or higher and 50° C. or lower, and that a value of tan δ in a cross sectional direction of the whole charging roller is 0.2 or less at 10 Hz in a range of 10° C. or higher and 50° C. or lower.

In addition, the present invention provides a process cartridge which supports an electrophotographic photosensitive member, a charging member, and either or both of developing means and cleaning means in one piece, and can be freely detached and attached on an electrophotographic apparatus body, the process cartridge being characterized by using the above-mentioned charging roller, and in that the charging member is a charging member charging the electrophotographic photosensitive member by being arranged on contact with the electrophotographic photosensitive member and a voltage including an AC component being applied.

Furthermore, the present invention provides an electrophotographic apparatus which has an electrophotographic photosensitive member, a charging member, exposure means, developing means, and transfer means, the electrophotographic apparatus being characterized by using the above-mentioned charging roller, and in that the charging member is a charging member charging the electrophotographic photosensitive member by being arranged on contact with the electrophotographic photosensitive member and a voltage including an AC component being applied.

Thereby, the present invention can provide a charging roller, which reduces noise generated from the charging roller (charging noise), prevents deformation due to compression set, and can obtain a stable and satisfactory uniform charging characteristic and output image quality, a process cartridge and an electrophotographic apparatus which each have the charging roller.

DESCRIPTION OF THE PREFERRED EMBODIMENTS

Figure 1:
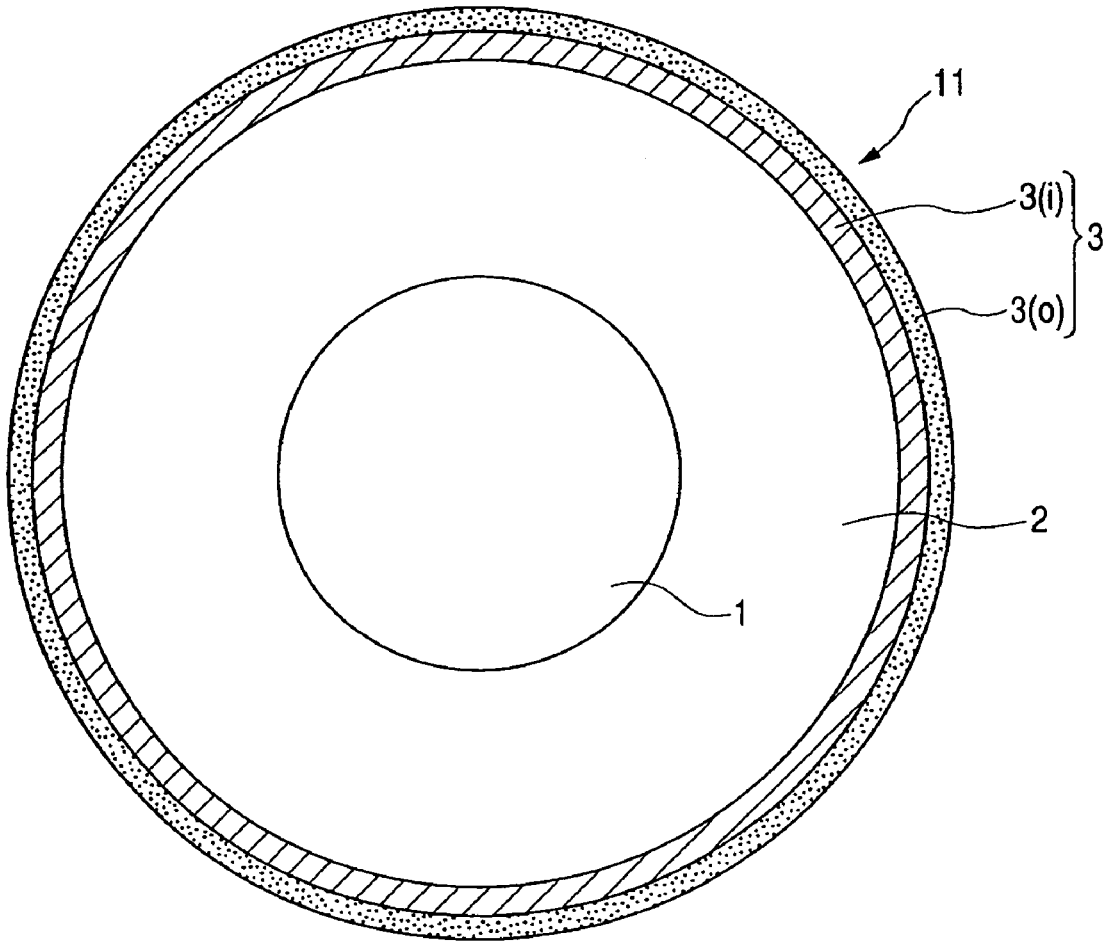
FIG. 1 is a schematic sectional diagram of a charging roller of the present invention.

Hereafter, embodiments of the present invention will be explained in detail.

As a result of wholehearted investigation, the present inventors paid attention to the fact that charging noise to be generated is derived from a charging frequency and its integral multiple overtones, as means of suppressing occurrence of the charging noise, that is, noise due to vibration of a charging roller, instead of simply enlarging tan δ of the charging roller and providing damping. Then, it becomes possible to suppress the charging noise and to make a permanent set by abutting small by a design of enlarging tan δ at a charging frequency and in a range of from 1 kHz or higher, which is a region of its integral multiple overtones, to 20 kHz, which is a limit of hearing ability of a human being, inclusive, and of lessening tan δ in a low-frequency range.

That is, since a value of tan δ expressed in a ratio of a storage elastic modulus and a loss elastic modulus by dynamic viscoelasticity in a cross-sectional direction of the charging roller at 25° C. is 0.2 or more in a range of 1 kHz or more and 20 kHz or less, and 0.2 or less in a range of 1 Hz or more and 10 Hz or less, it becomes possible to suppress charging noise such as charging sound pressure and charging noise ripple effectively. When a value of tan δ is less than 0.2 in a range of 1 kHz or more and 20 kHz or less, it is not possible to absorb enough vibrations which become sound sources at the charging frequency and its integral multiple overtones. Hence, the charging noise becomes large, which becomes a problem in audibility. In addition, when the value of tan δ exceeds 0.2 in a range of 1 Hz or more and 10 Hz or less, an abutting portion of the charging roller to the electrophotographic photosensitive member is deformed by permanent set in long term storage. Hence, there arise problems such as a poor image and deterioration of charging noise in connection with the shape deterioration.

Furthermore, as a result of the wholehearted investigation, it was found that it becomes possible to suppress charging noise effectively by providing a layer with large tan δ in the charging roller, and in particular, providing a layer with large tan δ in a layer near a surface instead of simply enlarging tan δ of the charging roller and providing damping as means of suppressing occurrence of the charging noise, that is, noise due to vibration of the charging roller. Moreover, it becomes possible to suppress the charging noise and to make small the permanent set due to the abutting by using a material with small tan δ in other layers to suppress tan δ as the whole charging roller. Then, in the present invention, a layer with large tan δ is provided in a conductive covering member nearer to a surface. However, here, although it is possible to further suppress the charging noise effectively by providing a layer with large tan δ in a top layer, it becomes difficult to make the compression permanent set due to abutting to a small level that there is no problem in image quality since the layer directly contacts with the electrophotographic photosensitive member. Hence, it is indispensable to provide the layer besides the top layer.

Thus, when a conductive covering member is constructed of two or more layers, a value of tan δ expressed by the ratio of an storage elastic modulus and a loss elastic modulus by dynamic viscoelasticity in at least one layer other than a surface layer is 0.2 or more at 10 Hz in a range of 10° C. or higher and 50° C. or lower, and the value of tan δ in a cross-sectional direction of the whole charging roller is 0.2 or less on the same conditions as the above-described, it becomes possible to suppress charging noise such as charging sound pressure and charging noise ripples effectively. When a value of tan δ of at least one layer except a top layer is less than 0.2, it is not possible to absorb enough vibrations which become sound sources at the charging frequency and its integral multiple overtones. Hence, the charging noise becomes large, which becomes a problem in audibility. On the other hand, when the value of tan δ in the cross-sectional direction of the whole charging roller exceeds 0.2, a loss elastic modulus of the charging roller becomes high, and hence, a poor image due to deformation is generated.

FIG. 1 shows an example of construction of the charging roller 11 of the present invention. FIG. 1 shows the case that there are two conductive coat layers. In the figure, reference numeral 1 denotes a conductive base, reference numeral 2 denotes a foaming elastic layer, reference numeral 3 denotes conductive covering layers, reference character 3(*i*) denotes an internal layer, and reference character 3(*o*) denotes a top layer.

As a material of the conductive base 1, metal such as iron, copper, or stainless steel, carbon dispersion resin, metal or metal oxide dispersion resin, or the like is used. As its shape, cylindrical, tabular, and other shapes can be used. For example, as an elastic roller, what is constructed of a foaming elastic layer 2 provided on the conductive base, and a conductive layer or a resistor layer thereon provided is used. The foaming elastic layer can be formed from rubber or sponge, such as chloroprene rubber, isoprene rubber, EPDM rubber, polyurethane rubber, epoxy rubber, and isobutylene-isoprene rubber, and thermoplastic resins, such as styrene butadiene, polyurethane, polyester, and ethylene vinyl acetate. It is also sufficient to make these rubber and resins contain electroconductive agents, such as carbon black, metal, and metal oxide particulates.

Although a material, a production method, and the like of a conductive covering layer 3 are not particularly restricted, a seamless tube is preferable from the aspect of excellent production stability and stable manufacturability of a middle resistance region which is said conventionally to be difficult to stably produce.

Although a material used for the conductive covering member is not restricted particularly, it is preferable to be a seamless tube including a thermoplastic elastomer. However, according to the present invention, tan δ of the internal layer 3(*i*) needs to be 0.2 or more in the below-mentioned measuring method.

As thermoplastic elastomers, specifically, an olefin system (TPO), a styrene system (TPS), a polyurethane system (TPU), an ester system (TPEE), an amide system (TPA), a polyvinyl chloride system (PVC), and the like are mentioned. It is also sufficient to make these thermoplastic elastomers contain electroconductive agents, such as carbon black, metal, and metal oxide particulates.

In addition, it is satisfactory to further add a thermoplastic resin, an inorganic pigment, or the like besides the above-mentioned thermoplastic elastomers so as to adjust tan δ in the desired range of the present invention.

Next, as a production method of a seamless tube which forms the conductive covering layer of the present invention, a thermoplastic elastomer and an electroconductive pigment such as carbon black are first kneaded with a required additive, and then, they are pelletized. Next, the obtained pellets are made into a seamless tube with a mold extruder. Then, the molded seamless tube is made to cover a support member, and they are made a conductive member.

Although there is particularly no restriction in thickness of the seamless tube in the present invention, it is preferably in a range of 100 μm or more and 600 μm or less. In addition, use of a multilayer co-molding tube is also satisfactory.

Furthermore, the materials, film thickness, and the like of the above-mentioned respective layers and respective members are adjusted so that tan δ may become in the desired range of the present invention.

Figure 2:
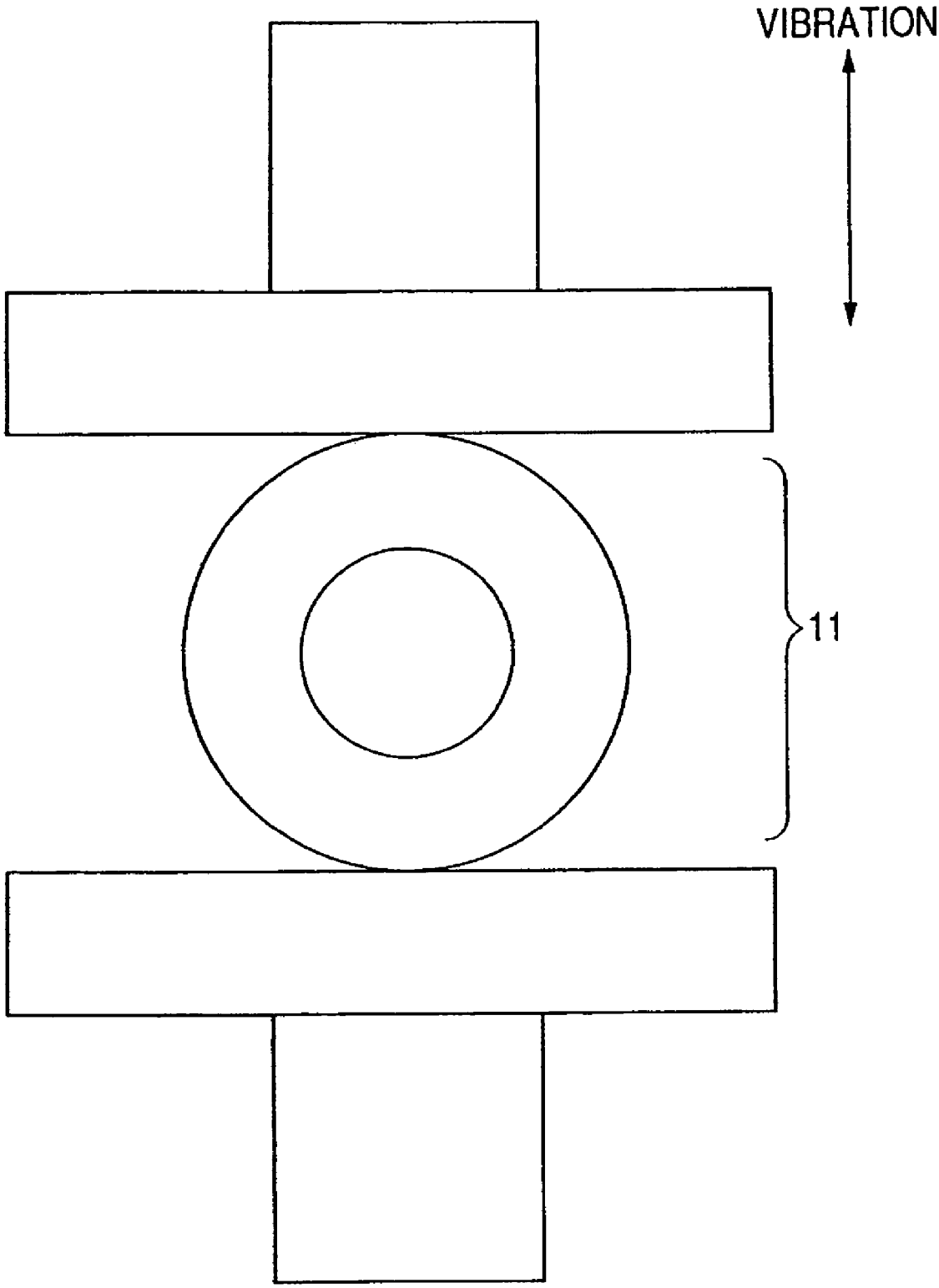
FIG. 2 is a schematic diagram of a dynamic viscoelasticity measuring method of the charging roller of the present invention.

Measurement of dynamic viscoelasticity of a charging roller was performed on the basis of "Test methods of measuring dynamic property of vulcanizate" of Japanese Industrial Standards K6394, FIG. 2 shows a measuring apparatus and means of dynamic viscoelasticity of the charging roller 11 according to the present invention. The procedure of measurement of the dynamic viscoelasticity of the charging roller 11 was the steps of cutting off a part of the roller by 10.0 mm in length in an axial direction, and subsequently, cutting off a part, which was the electroconductive elastic layer of the roller, along with a tangential line of the conductive base 1 to make it into a measuring sample. Next, as shown in FIG. 2, the procedure was the steps of fixing an intercept of the charging roller 11, applying a static load of 430 mN, applying sinusoidal vibration, whose frequency and amplitude were set by an electrodynamic vibration controller, from its upper part, and detecting stress response generated at that time. A storage elastic modulus (E') and a loss elastic modulus (E") were calculated from a dynamic stress waveform and a dynamic displacement waveform which were obtained, and tan δ was measured from a ratio of those.

Measurement of the dynamic viscoelasticity of the conductive covering layer was performed on the basis of Japanese Industrial Standards K6394, Measuring procedure of the conductive covering layer was the steps of molding each layer individually in a sheet shape with a pressing machine, or the like, cutting it into dimensions of 0.40 mm D×6.0 mm W×26 mm L, applying a static load of 100 mN in a longitudinal tensile direction, applying sinusoidal vibration, whose frequency and amplitude were set by an electrodynamic vibration controller, and detecting stress response generated at that time. A storage elastic modulus (E') and a loss elastic modulus (E") were calculated from a dynamic stress waveform and a dynamic displacement waveform which were obtained, and tan δ was measured from a ratio of those.

Figure 3:
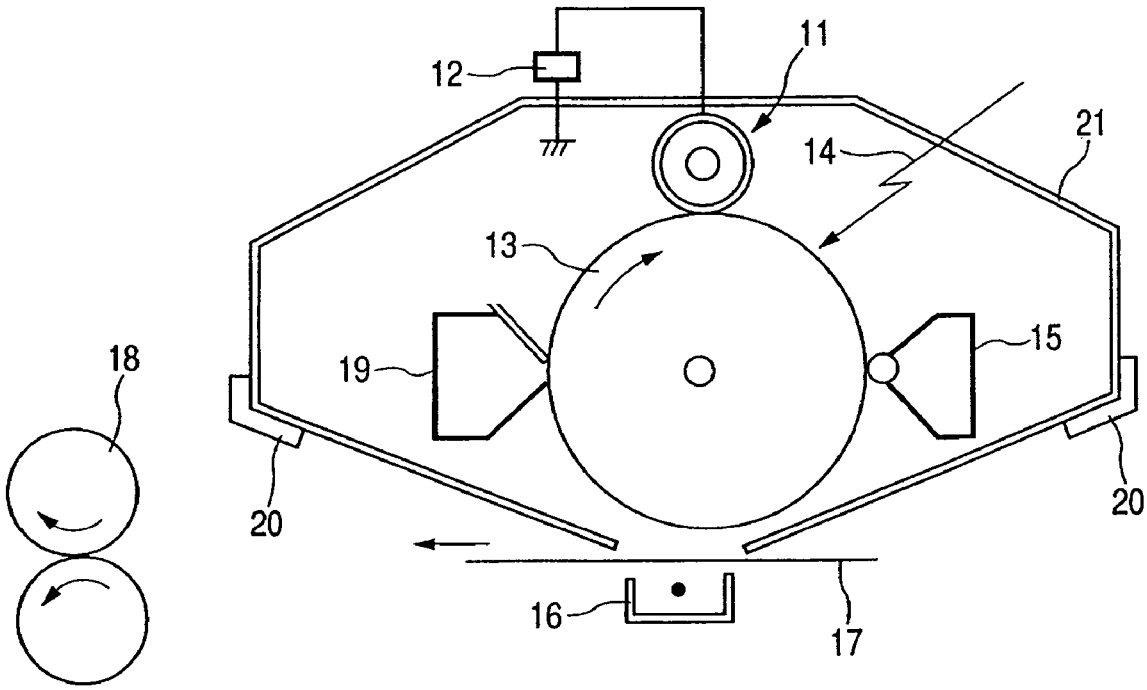
FIG. 3 is a schematic structural diagram of an electrophotographic apparatus providing a process cartridge which has the charging roller of the present invention.

FIG. 3 shows an example of construction of an electrophotographic apparatus providing a process cartridge which has the charging roller of the present invention as primary charging means. The electrophotographic photosensitive member, exposure means, developing means, transfer means, and cleaning means which are used for the present invention are not limited particularly.

In FIG. 3, reference numeral 13 denotes an electrophotographic photosensitive member and is rotationally driven at predetermined peripheral velocity in an arrow direction. The electrophotographic photosensitive member 13 is given uniform charging at positive or negative predetermined potential, which includes an AC component on its peripheral surfaces by the charging roller 11 of the present invention, which is arranged on contact with the electrophotographic photosensitive member 13, as the primary charging means in a rotation process, and subsequently, is given exposing light 14 from exposure means (not shown) such as slit exposure and laser beam scanning exposure. In this way, an electrostatic latent image is sequentially formed on the peripheral surface of the electrophotographic photosensitive member 13.

The formed electrostatic latent image is subsequently given toner development by developing means 15. The developed toner development image is sequentially transferred by transferring equipment 16 on a transferring material 17 which is synchronized with rotation of the electrophotographic photosensitive member 13 and is fed between the electrophotographic photosensitive member 13 and transfer means 16 from a sheet feeding part (not shown).

The transferring material 17 which is given the image transfer is printed out outside the apparatus as a duplication (copy) by being separated from a surface of the electrophotographic photosensitive member, being introduced into image fixing means 18, and being given image fixing.

The surface of the electrophotographic photosensitive member 13 after the image transfer is made into a clean surface by being given removal of toner, left after transfer, by cleaning means 19, and is used for image formation repeatedly.

In addition, in FIG. 3, reference numeral 20 denotes guide means and reference numeral 21 denotes the process cartridge.

Hereinafter, although embodiments are explained, the present invention is not limited to the embodiments. In addition, a "part(s)" in these embodiments shows a part(s) by mass.

(Example of Production of Foaming Elastic Layer Support Member/Elastic Layer 1-1)

As a conductive base, it was prepared by extruding an iron material into a bar of 6 mm in a diameter by extrusion molding, and chemical plating this in thickness of about 3 μm after cutting it in length of 250 mm. Next, as a material of the foaming elastic layer, rubber compound was obtained by mixing 100 parts of styrene butadiene rubber (SBR), 10 parts of carbon black (primary particle size: 30 nm, specific surface area: 1200 $m^2/g$, DBP oil absorption: 500, and pH: 9.0), and proper quantity of foaming agent, vulcanizing agent, and other additives, and kneading and diverging them with two rollers. A tube-like foaming elastic layer with 12.5 mm of diameter, 250 mm of length, and a center hole of diameter of 4 mm was produced by mold extruding the obtained rubber compound with a single spindle extruder into a tubular shape, and performing 30-minutes foaming and vulcanization in the steam of 160° C. and 0.7 MPa. A conductive sponge rubber base layer was made by making this foaming elastic layer tube cover the above-mentioned conductive base which was coated with a conductive adhesive on its surface, vulcanizing them for 30 minutes in the steam of 200° C. and 0.7 MPa, and thereafter, cutting unnecessary end parts of the rubber by 1 cm. Then, a foaming elastic layer support member of 11.4 mm in a diameter was obtained by polishing.

(Example of Production of Foaming Elastic Layer Support Member/Elastic Layer 1-2)

As a conductive base, it was prepared by extruding an iron material into a bar of 6 mm in a diameter by extrusion molding, and chemical plating this in thickness of about 3 μm after cutting it in length of 250 mm. Next, as a material of the foaming elastic layer, rubber compound was obtained by mixing 100 parts of ethylene-propylene diene rubber (EPDM), 10 parts of carbon black (primary particle size: 30 nm, specific surface area: 1200 $m^2/g$, DBP oil absorption: 500, and pH: 9.0), and proper quantity of foaming agent, vulcanizing agent, and other additives, and kneading and dispersing them with two rollers. A tubular foaming elastic layer with 12.5 mm of diameter, 250 mm of length, and a center hole of diameter of 4 mm was produced by mold extruding the obtained rubber compound with a single spindle extruder into a tubular shape, and performing 30-minutes foaming and vulcanization in the steam of 160° C. and 0.7 MPa. A conductive sponge rubber base layer was made by making this foaming elastic layer tube cover the above-mentioned conductive base which was coated with a conductive adhesive on its surface, vulcanizing them for 30 minutes in the steam of 200° C. and 0.7 MPa, and thereafter, cutting unnecessary end parts of the rubber by 1 cm. Then, a foaming elastic layer support member of 11.4 mm in a diameter was obtained by polishing.

(Seamless Tube Production Example 1/Tube 1-1)

For a tube surface layer, pellets were made with a granulating extruder after the steps of kneading 60 parts of styrene-hydrogenated butadiene-crystalline olefin block copolymer elastomer (SEBC) (20% of styrene content) 40 parts of high impact polystyrene (HIPS), 10 parts of carbon black (primary particle size: 30 nm, specific surface area: 800 $m^2/g$, DBP oil absorption: 360, and pH: 9.0), and one part of calcium stearate at 180° C. for 15 minutes using a pressure type kneader, and cooling and pulverizing the kneaded material.

For an intra-tube layer, pellets were made with a granulating extruder after the steps of kneading 100 parts of thermoplastic polyurethane elastomer (TPU), 16 parts of carbon black (primary particle size: 30 nm, specific surface area: 800 $m^2/g$, DBP oil absorption: 360, and pH: 9.0), and one part of calcium stearate at 180° C. for 15 minutes using a pressure type kneader, and cooling and pulverizing the kneaded material.

The seamless tube with internal diameter of 11.1, mm, surface layer thicknesst of 100 μm, and intra-tube layer thickness of 400 μm which was used as a conductive covering layer was made after the steps of performing extrusion molding with a two-color mold extruder, equipped with a dice in internal diameter of 16.5 mm and a point in outer diameter of 18.5 mm, using the above-mentioned pellets, and sizing and cooling the extrusion.

(Seamless Tube Production Example 2/Tube 1-2)

For an intra-tube layer, pellets were made with a granulating extruder after the steps of kneading 100 parts of styrene-butadiene-styrene block copolymer elastomer (SBS), 16 parts of carbon black (primary particle size: 30 nm, specific surface area: 800 $m^2/g$, DBP oil absorption: 360, and pH: 9.0), and one part of calcium stearate at 180° C. for 15 minutes using a pressure type kneader, and cooling and pulverizing the kneaded material. Pellets for a tube surface layer and subsequent steps were the same as production steps of the seamless tube production example 1, Thereby, a seamless tube with internal diameter of 11.1 mm, surface layer thickness of 100 μm, and intra-tube layer thickness of 400 μm which was used as a conductive covering layer was made.

EXAMPLES 1-1 AND 1-2, AND COMPARATIVE EXAMPLES 1-1 AND 1-2

The obtained seamless tube used as a conductive covering layer was made to cover the above-mentioned foaming elastic layer support member, and the charging roller 11 as shown in FIG. 1 was produced. Combinations of a seamless tube and a foaming elastic layer support member are shown in Table 1, Evaluation methods of them will be described below.

<Evaluation of Dynamic Viscoelasticity>

Each sample in longitudinal length (T) of 10.0 mm was produced by cutting each charging roller obtained in examples and comparative examples into 10.0 mm long in an axial direction, and subsequently, cutting off a foaming elastic layer and a conductive covering layer along with a tangential line of a conductive base. Each sample was set as shown in FIG. 2 to be measured under the following conditions.

Measuring device: EXSTAR6000 DMS (made by SII NanoTechnology Inc.)

Compressed stimulus: (load control, static load: about 430 mN, strain-amplitude: 5.0.μm, sinusoidal wave)

Temperature: −50° C. or higher and 100° C. or lower

Frequencies: 1, 2, 5, 10, 20, 50 and 100 Hz

From temperature-frequency dispersion, for example, a shift factor αT of a WLF (Williams, Landel, and Ferry) law was obtained like description in "Polymer Chemistry, Version 3, KYORITSU SHUPPAN CO., LTD., pp. 274–277", and a master curve at the fiducial temperature of 25° C. was made. Then, tan δ was calculated from a storage elastic modulus and a loss elastic modulus.

<Measurement of Charging Sound Pressure>

On conditions of applying a 9.8-N load to both end parts of a shaft of each charging roller obtained in the examples and comparative examples, pressing it against an electrophotographic photosensitive drum with outer diameter of 30 mm, and applying an AC electric field at a peak-to-peak voltage of 2 kV/1600 Hz, sound pressure and ripple of sound pressure were measured using a sound pressure meter (LA-5110, made by ONO SOKKI CO., LTD.) put on a place apart 200 mm. The result of the evaluation test is shown in Table 1.

<Severe Storage Evaluation>

Each charging roller obtained in the examples and comparative examples had been assembled in a process cartridge shown in FIG. 3, which had been left for 30 days in a severe storage environment (40° C./95% RH). Then, each process cartridge was mounted into a laser beam printer (primary charging: roller direct DC charging), and an image output was performed. Further, it was confirmed whether there was any poor image in a position equivalent to an abutting portion of the charging roller and electrophotographic photosensitive member. The result is shown in Table 1, In addition, a "A" in the table means that there was not poor image in a position equivalent to an abutting portion position, and a "C" means that there arose a poor image, such as a black stripe, in the position equivalent to the abutting portion.

TABLE 1

| | | Example 1-1 | Example 1-2 | Comparative example 1-1 | Comparative example 1-2 |
|---|---|---|---|---|---|
| Foaming elastic layer | | Elastic layer 1-1 Tube 1-1 | Elastic layer 1-2 Tube 1-2 | Elastic layer 1-1 Tube 1-2 | Elastic layer 1-2 Tube 1-1 |
| tanδ | 1 Hz | 0.13 | 0.16 | 0.21 | 0.14 |
| | 10 Hz | 0.15 | 0.17 | 0.23 | 0.14 |
| | 1 kHz | 0.24 | 0.22 | 0.32 | 0.15 |
| | 20 kHz | 0.36 | 0.30 | 0.42 | 0.17 |
| Charging sound pressure (dB) | | 50 | 48 | 47 | 60 |
| Charging noise ripple (dB) | | 2 | 3 | 6 | 4 |
| Image quality (severe storage) | | A | A | C (Stripe occurrence in abutting portion) | A |

(Example of Production of Foaming Elastic Layer Support Member/Elastic Layer 2-1)

As a conductive base, it was prepared by extruding an iron material into a bar of 6 mm in a diameter by extrusion molding, and chemical plating this in thickness of about 3 μm after cutting it in length of 250 mm. Next, as a material of the foaming elastic layer, rubber compound was obtained by mixing 100 parts of ethylene propylene diene rubber (EPDM), 10 parts of carbon black (primary particle size: 30 nm, specific surface area: 1200 $m^2/g$, DBP oil absorption:

500, and pH: 9.0), and proper quantity of foaming agent, vulcanizing agent, and other additives, and kneading and diverging them with two rollers. A tubular foaming elastic layer with 12.5 mm of diameter, 250 mm of length, and a center hole of diameter of 4 mm was produced by mold extruding the obtained rubber compound with a single spindle extruder into a tubular shape, and performing 30-minutes foaming and vulcanization in the steam of 160° C. and 0.7 MPa. A conductive sponge rubber base layer was made by making this foaming elastic layer tube cover the above-mentioned conductive base which was coated with a conductive adhesive on its surface, curing them for 30 minutes in the steam of 200° C. and 0.7 MPa, and thereafter, cutting unnecessary end parts of the rubber by 1 cm. Then, a foaming elastic layer support member of 11.5 mm in a diameter was obtained by polishing.

(Seamless Tube Production Example 4/Tube 2-1)

For a tube surface layer, pellets were made by melt extrusion with a single screw extruder after the steps of kneading 60 parts of styrene-hydrogenated butadiene-crystalline olefin block copolymer elastomer (SEBC) (20% of styrene content), 40 parts of high impact polystyrene (HIPS), 10 parts of carbon black (primary particle size: 30 nm, specific surface area: 800 $m^2/g$, DBP oil absorption: 360, and pH: 9.0), and one part of calcium stearate at 180° C. for 15 minutes using a pressure type kneader, and cooling and pulverizing the kneaded material.

For an intra-tube layer, pellets were made with a granulating extruder after the steps of kneading 100 parts of block copolymer of thermoplastic polyurethane elastomer (TPU) and-styrene-isoprene-styrene block copolymer elastomer (SIS), 16 parts of carbon black (primary particle size: 30 nm, specific surface area:. 800 $m^2/g$, DBP oil absorption: 360, and pH: 9.0), and one part of calcium stearate at 180° C. for 15 minutes using a pressure type kneader, and cooling and grinding the kneaded material.

The seamless tube with internal diameter of 11.1 mm, surface layer thickness of 100 μm, and intra-tube layer thickness of 400 μm which was used as a conductive covering layer was made after the steps of performing extrusion molding with a two-color mold extruder, equipped with a dice in internal diameter of 16.5 mm and a point in outer diameter of 18.5 mm, using the above-mentioned pellets, and sizing and cooling the extrusion.

(Seamless Tube Production Example 5/Tube 2-2)

For an intra-tube layer, pellets were made by melt extrusion with a single screw extruder after the steps of kneading 100 parts of styrene-isoprene-styrene block copolymer elastomer: (SIS), 16 parts of carbon black (primary particle size: 30 nm, specific surface area: 800 $m^2/g$, DBP oil absorption: 360, and pH: 9.0), and one part of calcium stearate at 180° C. for 15 minutes using a pressure type kneader, and cooling and pulverizing the kneaded material. Pellets for a tube surface layer and subsequent steps were the same as production steps of the example 4 of seamless tube production. Thereby, a seamless tube with internal diameter of 11.1 mm, surface layer thickness of 100 μm, and intra-tube layer thickness of 400 μm which was used as a conductive covering layer was made.

(Seamless Tube Production Example 6/Tube 2-3)

For an intra-tube layer, pellets were made by melt extrusion with a single screw extruder after the steps of kneading 100 parts of thermoplastic polyurethane-elastomer (TPU), 16 parts of carbon black (primary particle size: 30 nm, specific surface area: 800 $m^2/g$, DBP oil absorption: 360, and pH: 9.0), and one part of calcium stearate at 180° C. for 15 minutes using a pressure type kneader, and cooling and pulverizing the kneaded material. Pellets for a tube surface layer and subsequent steps were the same as production steps of the example 4 of seamless tube production. Thereby, a seamless tube with internal diameter of 11.1 mm, surface layer thickness of 100 μm, and intra-tube layer thickness of 400 μm which was used as a conductive covering layer was made.

EXAMPLES 2-1 AND 2-2, AND COMPARATIVE EXAMPLE 2-1

The obtained seamless tube used as a conductive covering layer was made to cover the above-mentioned foaming elastic layer support member, and the charging roller 11 as shown in FIG. 1 was produced. Combinations of a seamless tube and a foaming elastic layer support member are shown in Table 2, Evaluation methods of them will be described below.

<Evaluation of Dynamic Viscoelasticity/Conductive covering Layer Material>

Each sample was made by forming the pellets for intra-tube layers obtained in the examples of seamless tube production into a 1.0-mm-thick sheet with a hot press, and cutting the sheet into pieces with 26.0 mm of length, and 6.0 mm of width, and was measured under the following conditions.

Measuring device: EXSTAR6000 DMS (made by SII NanoTechnology Inc.)

Tension stimulus: (load control, static load: about 100 mN, strain amplitude: 5.0 μm, sinusoidal wave)

Temperature: −50° C. or higher and 100° C. or lower Frequency: 10 Hz

<Evaluation of Dynamic Viscoelasticity/Charging Roller>

Each sample in longitudinal length (T) of 10.0 mm was produced by cutting each charging roller obtained in examples and comparative examples into 10.0 mm long in an axial direction, and subsequently, cutting off a foaming elastic layer and a conductive covering layer along with a tangential line of a conductive base. Each sample was set as shown in FIG. 2, and was measured under the following conditions.

Measuring device: EXSTAR6000 DMS (made by SII NanoTechnology Inc.)

Compressed stimulus: (load control, static load: about 430 mN, strain amplitude: 5.0 μm, sinusoidal wave)

Temperature: −50° C. or higher and 100° C. or lower Frequency: 10 Hz

<Measurement of charging Sound Pressure>

Measurement was performed similarly to that in the above-mentioned first example. The result is shown in Table 2.

<Severe Storage Evaluation>

Measurement was performed similarly to that in the above-mentioned first example. The result is shown in Table 2,

TABLE 2

| | | Example 2-1 | Example 2-2 | Comparative example 2-1 |
|---|---|---|---|---|
| Tube | | Tube 2-1 | Tube 2-2 | Tube 2-3 |
| tanδ of internal layer | Max | 0.50 | 0.60 | 0.18 |
| (10–50° C./10 Hz) | Min | 0.20 | 0.25 | 0.16 |
| tanδ of charging roller | Max | 0.18 | 0.19 | 0.14 |
| (10–50° C./10 Hz) | Min | 0.11 | 0.10 | 0.05 |
| Charging sound pressure (dB) | | 51 | 49 | 57 |
| Charging noise ripple (dB) | | 2 | 3 | 6 |
| Image quality (severe storage) | | A | A | A |

Thereby, it is possible to provide a charging roller, which reduces noise generated from the charging roller (charging noise), prevents deformation due to compression set, and can obtain a stable and satisfactory uniform charging characteristic and output image quality, a process cartridge and an electrophotographic apparatus which each have the charging roller.

This application claims priorities from Japanese Patent Applications No. 2005-044045 filed Feb. 21, 2005, No. 2005-044046-filed Feb. 21, 2005 and No. 2006-027023 filed Feb. 3, 2006, which are hereby incorporated by reference herein.

What is claimed is:

1. A charging roller comprising:

a support member; and a conductive covering member, wherein a value of dynamic viscoelasticity tan δ is expressed as follows:

tan δ=loss elastic modulus/storage elastic modulus in a cross-sectional direction of the charging roller at 25° C. is 0.2 or more in a range of 1 kHz or more and 20 kHz or less, and 0.2 or less in a range of 1 Hz or more and 10Hz or less.

2. A charging roller comprising:

a support member; and a conductive covering member, wherein the conductive covering member is constructed of two or more layers, wherein a value of dynamic viscoelasticity tan δ is expressed, as follows tan δ=loss elastic modulus/storage elastic modulus in at least one layer other than a surface layer is 0.2 or more at 10 Hz in a range of 10° C. or higher and 50° C. or lower, and wherein the value of tan δ in a cross-sectional direction of the whole charging roller is 0.2 or less at 10 Hz in a range of 10° C. or higher and 50° C. or lower.

3. A process cartridge comprising an electrophotographic photosensitive member, a charging member, and at least one of developing means and cleaning means being provided as a unit, and and being freely detachable and attachable on an electrophotographic apparatus main body, and the charging roller according to claim 1 or 2, wherein the charging member is a charging member charging the electrophotographic photosensitive member by being arranged on contact with the electrophotographic photosensitive member and a voltage including an AC component being applied.

4. An electrophotographic apparatus comprising an electrophotographic photosensitive member, a charging member, exposure means, developing means, transfer means, and the charging roller according to claim 1 or 2, wherein the charging member changes the electrophotographic photosensitive member by contacting with the electrophotographic photosensitive member, wherein a voltage including an AC component being is applied thereto.

* * * * *

UNITED STATES PATENT AND TRADEMARK OFFICE

CERTIFICATE OF CORRECTION

PATENT NO. : 7,209,683 B2
APPLICATION NO. : 11/434121
DATED : April 24, 2007
INVENTOR(S) : Hiroshi Abe et al.

It is certified that error appears in the above-identified patent and that said Letters Patent is hereby corrected as shown below:

ON THE COVER PAGE:

(57) ABSTRACT, lines 4 and 5, "cross sectional" should read --cross-sectional--.
Line 11, "cross sectional" should read --cross-sectional--.

(73) Assignee, "Tsukuba-shi (JP)" should read --Tsukuba (JP)--.

ON PAGE 2:

(56) FOREIGN PATENT DOCUMENTS

| | | |
|---|---|---|
| "JP | 08262835 | 10/1996" should be deleted. |
| "JP | 04025868 | 1/1992 |
| JP | 10319676 | 12/1998 |
| JP | 11125892 | 5/1999" should read |
| --JP | 4-25868 | 1/1992 |
| JP | 10-319676 | 12/1998 |
| JP | 11-125892 | 5/1999--. |

COLUMN 1:

Line 33, "a" should read --an--.

COLUMN 3:

Line 67, "cross" should read --cross- --.

COLUMN 4:

Line 2, "a:" should read --a--.
Line 13, "cross sectional" should read --cross-section--.

COLUMN 7:

Line 20, "K6394," should read --K6394.--.

COLUMN 9:

Line 52, "Table 1," should read --Table 1.--.

COLUMN 10:

Line 32, "Table 1," should read --Table 1.--.

UNITED STATES PATENT AND TRADEMARK OFFICE

CERTIFICATE OF CORRECTION

PATENT NO. : 7,209,683 B2
APPLICATION NO. : 11/434121
DATED : April 24, 2007
INVENTOR(S) : Hiroshi Abe et al.

It is certified that error appears in the above-identified patent and that said Letters Patent is hereby corrected as shown below:

COLUMN 12:

Line 15, "Table 2," should read --Table 2.--.

COLUMN 14:

Line 10, "and" (second occurrence) should be deleted.
Line 24, "changes" should read --charges--.
Line 27, "being" should be deleted.

Signed and Sealed this

Twenty-fifth Day of December, 2007

JON W. DUDAS
*Director of the United States Patent and Trademark Office*